US009218821B2

(12) United States Patent
Lu et al.

(10) Patent No.: US 9,218,821 B2
(45) Date of Patent: Dec. 22, 2015

(54) MEASURING CONTENT COHERENCE AND MEASURING SIMILARITY

(75) Inventors: Lie Lu, Beijing (CN); Mingqing Hu, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 129 days.

(21) Appl. No.: 14/237,395

(22) PCT Filed: Aug. 7, 2012

(86) PCT No.: PCT/US2012/049876

§ 371 (c)(1), (2), (4) Date: Feb. 6, 2014

(87) PCT Pub. No.: WO2013/028351

PCT Pub. Date: Feb. 28, 2013

(65) Prior Publication Data

US 2014/0205103 A1 Jul. 24, 2014

Related U.S. Application Data

(60) Provisional application No. 61/540,352, filed on Sep. 28, 2011.

(30) Foreign Application Priority Data

Aug. 19, 2011 (CN) ..... 2011 1 0243107

(51) Int. Cl.
*G10L 25/51* (2013.01)
*H04R 29/00* (2006.01)

(52) U.S. Cl.
CPC ..... *G10L 25/51* (2013.01); *H04R 29/00* (2013.01)

(58) Field of Classification Search
CPC ..... H04R 29/00; H04R 29/008; H04R 3/00; H04R 2499/11; H04R 29/004; H04R 3/005; H04R 3/04
USPC ..... 381/56, 91, 92, 122
See application file for complete search history.

(56) References Cited

U.S. PATENT DOCUMENTS 6,542,869 B1 4/2003 Foote
7,447,318 B2 * 11/2008 Button et al. ..... 381/55

(Continued)

FOREIGN PATENT DOCUMENTS

EP 1073272 1/2001
JP 2004-333605 11/2004

OTHER PUBLICATIONS

Foote, J., "Automatic Audio Segmentation Using a Measure of Audio Novelty," IEEE International Conference on Multimedia and Expo, vol. 1, pp. 452-455, Jul. 30-Aug. 2, 2000.

(Continued)

*Primary Examiner* — Mark Blouin

(57) ABSTRACT

Embodiments for measuring content coherence and embodiments for measuring content similarity are described. Content coherence between a first audio section and a second audio section is measured. For each audio segment in the first audio section, a predetermined number of audio segments in the second audio section are determined. Content similarity between the audio segment in the first audio section and the determined audio segments is higher than that between the audio segment and all the other audio segments in the second audio section. An average of the content similarity between the audio segment in the first audio section and the determined audio segments is calculated. The content coherence is calculated as an average, the maximum or the minimum of the averages calculated for the audio segments in the first audio section. The content similarity may be calculated based on Dirichlet distribution.

20 Claims, 5 Drawing Sheets

(56) References Cited

U.S. PATENT DOCUMENTS

| | | | | |
|---|---|---|---|---|
| 8,315,399 | B2 * | 11/2012 | De Poortere | 381/56 |
| 8,837,744 | B2 * | 9/2014 | Yonekubo et al. | 381/56 |
| 8,842,851 | B2 * | 9/2014 | Beaucoup | 381/92 |
| 8,885,842 | B2 * | 11/2014 | Chen | 381/58 |
| 8,958,570 | B2 * | 2/2015 | Matsuo | 381/92 |
| 2006/0065106 | A1 | 3/2006 | Pinxteren | |
| 2008/0288255 | A1 | 11/2008 | Carin | |

OTHER PUBLICATIONS

Chen, S. et al, "Speaker, Environment and Channel Change Detection and Clustering Via the Bayesian Information Criterion," DARPA Broadcast News Transciption Workshop, Feb. 8-11, 1998.

Ellis, D. et al. "Minimal Impact Audio Based Personal Archives," Proceedings of the First ACM Workshop on Continuous Archival and Retrieval of Personal Experiences, pp. 39-47, Oct. 15, 2004.

Sundaram, H. et al, "Audio Scene Segmentation Using Multiple Features, Models, and Time Scales," IEEE International Conference on Acoustic, Speech and Signal Processing, vol. 4, pp. 2,441-2,444, Jun. 5-9, 2000.

Tzanetakis, G. et al, "Multifeature Audio Segmentation for Browsing and Annotation," IEEE Workshop on Applications of Signal Processing to Audio and Acoustics, pp. 17-20, Oct. 17-20, 1999.

Wakefield, G., "Mathematical Representation of Joint Time-Chroma Distributions," SPIE, vol. 3807, pp. 637-645, Jul. 1999.

Blei, D. et al, "Latent Dirichlet Allocation," Journal of Machine Learning Research 3, pp. 993-1022, Jan. 2003.

Lu, L. et al, "Text-Like Segmentation of General Audio for Content-Based Retrieval," IEEE Transactions on Multimedia, vol. 11, Issue 4, pp. 658-669, Jun. 2009.

Penny, W., "KL-Divergences of Normal, Gamma, Dirichlet and Wishart Densities," Mar. 30, 2001.

Hanjalic, A., "Content-Based Analysis of Digital Audio," Kluwer Academic Publishers, Aug. 13, 2004.

Hoffman, M. et al, "Content-Based Musical Similarity Computation Using the Hierarchical Dirichlet Process," Proceedings of the 9th International Conference on Music Information Retrieval, Sep. 18, 2008.

Weiss, R. et al, "Unsupervised Discovery of Temporal Structure in Music," IEEE Journal of Selected Topics in Signal Processing, vol. 5, Issue 6, Oct. 2011.

Rauber, T. et al, "Probabilistic Distance Measures of Dirichlet and Beta Distributions," Pattern Recognition, Elsevier, vol. 41, Issue 2, Oct. 5, 2007.

* cited by examiner

MEASURING CONTENT COHERENCE AND MEASURING SIMILARITY

CROSS-REFERENCE TO RELATED APPLICATIONS

This application claims priority to Chinese Patent Application No. 201110243107.5, filed 19 Aug. 2011, and U.S. Patent Provisional Application No. 61/540,352, filed 28 Sep. 2011, each of which are hereby incorporated by reference in its entirety.

TECHNICAL FIELD

The present invention relates generally to audio signal processing. More specifically, embodiments of the present invention relate to methods and apparatus for measuring content coherence between audio sections, and methods and apparatus for measuring content similarity between audio segments.

BACKGROUND

Content coherence metric is used to measure content consistency within audio signals or between audio signals. This metric involves computing content coherence (content similarity or content consistency) between two audio segments, and serves as a basis to judge if the segments belong to the same semantic cluster or if there is a real boundary between these two segments.

Methods of measuring content coherence between two long windows have been proposed. According to the method, each long window is divided into multiple short audio segments (audio elements), and the content coherence metric is obtained by computing the semantic affinity between all pairs of segments and drawn from the left and right window based on the general idea of overlapping similarity links. The semantic affinity can be computed by measuring content similarity between the segments or by their corresponding audio element classes. (For example, see L. Lu and A. Hanjalic. "Text-Like Segmentation of General Audio for Content-Based Retrieval," *IEEE Trans. on Multimedia*, vol. 11, no. 4, 658-669, 2009, which is herein incorporated by reference for all purposes).

The content similarity may be computed based on a feature comparison between two audio segments. Various metrics such as Kullback-Leibler Divergence (KLD) have been proposed to measure the content similarity between two audio segments.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

SUMMARY

According to an embodiment of the invention, a method of measuring content coherence between a first audio section and a second audio section is provided. For each of audio segments in the first audio section, a predetermined number of audio segments in the second audio section are determined Content similarity between the audio segment in the first audio section and the determined audio segments is higher than that between the audio segment in the first audio section and all the other audio segments in the second audio section. An average of the content similarity between the audio segment in the first audio section and the determined audio segments are calculated. First content coherence is calculated as an average, the minimum or the maximum of the averages calculated for the audio segments in the first audio section.

According to an embodiment of the invention, an apparatus for measuring content coherence between a first audio section and a second audio section is provided. The apparatus includes a similarity calculator and a coherence calculator. For each of audio segments in the first audio section, the similarity calculator determines a predetermined number of audio segments in the second audio section. Content similarity between the audio segment in the first audio section and the determined audio segments is higher than that between the audio segment in the first audio section and all the other audio segments in the second audio section. The similarity calculator also calculates an average of the content similarity between the audio segment in the first audio section and the determined audio segments. The coherence calculator calculates first content coherence as an average, the minimum or the maximum of the averages calculated for the audio segments in the first audio section.

According to an embodiment of the invention, a method of measuring content similarity between two audio segments is provided. First feature vectors are extracted from the audio segments. All the feature values in each of the first feature vectors are non-negative and normalized so that the sum of the feature values is one. Statistical models for calculating the content similarity are generated based on Dirichlet distribution from the feature vectors. The content similarity is calculated based on the generated statistical models.

According to an embodiment of the invention, an apparatus for measuring content similarity between two audio segments is provided. The apparatus includes a feature generator, a model generator and a similarity calculator. The feature generator extracts first feature vectors from the audio segments. All the feature values in each of the first feature vectors are non-negative and normalized so that the sum of the feature values is one. The model generator generates statistical models for calculating the content similarity based on Dirichlet distribution from the feature vectors. The similarity calculator calculates the content similarity based on the generated statistical models.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF DRAWINGS

The present invention is illustrated by way of example, and not by way of limitation, in the figures of the accompanying drawings and in which like reference numerals refer to similar elements and in which.

DETAILED DESCRIPTION

Figure 1:
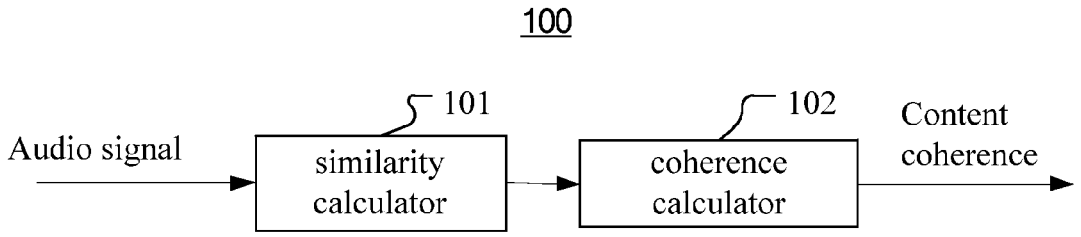
FIG. 1 is a block diagram illustrating an example apparatus for measuring content coherence according to an embodiment of the present invention.

The embodiments of the present invention are below described by referring to the drawings. It is to be noted that, for purpose of clarity, representations and descriptions about those components and processes known by those skilled in the art but not necessary to understand the present invention are omitted in the drawings and the description.

As will be appreciated by one skilled in the art, aspects of the present invention may be embodied as a system (e.g., an online digital media store, cloud computing service, streaming media service, telecommunication network, or the like), device (e.g., a cellular telephone, portable media player, personal computer, television set-top box, or digital video recorder, or any media player), method or computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof.

A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wired line, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

FIG. 1 is a block diagram illustrating an example apparatus 100 for measuring content coherence according to an embodiment of the present invention.

As illustrated in FIG. 1, apparatus 100 includes a similarity calculator 101 and a coherence calculator 102.

Various audio signal processing applications, such as speaker change detection and clustering in dialogue or meeting, song segmentation in music radio, chorus boundary refinement in songs, audio scene detection in composite audio signals and audio retrieval, may involve measuring content coherence between audio signals. For example, in the application of song segmentation in music radio, an audio signal is segmented into multiple sections, with each section containing a consistent content. For another example, in the application of speaker change detection and clustering in dialogue or meeting, audio sections associated with the same speaker are grouped into one cluster, with each cluster containing consistent contents. Content coherence between segments in an audio section may be measured to judge whether the audio section contains a consistent content. Content coherence between audio sections may be measured to judge whether contents in the audio sections are consistent.

In the present specification, the terms "segment" and "section" both refer to a consecutive portion of the audio signal. In the context that a larger portion is split into smaller portions, the term "section" refers to the larger portion, and the term "segment" refers to one of the smaller portions.

The content coherence may be represented by a distance value or a similarity value between two segments (sections). The greater distance value or smaller similarity value indicates the lower content coherence, and the smaller distance value or greater similarity value indicates the higher content coherence.

A predetermined processing may be performed on the audio signal according to the measured content coherence measured by apparatus 100. The predetermined processing depends on the applications.

The length of the audio sections may depend on the semantic level of object contents to be segmented or grouped. The higher semantic level may require the greater length of the audio sections. For example, in the scenarios where audio scenes (e.g., songs, weather forecasts, and action scenes) are cared about, the semantic level is high, and content coherence between longer audio sections is measured. The lower semantic level may require the smaller length of the audio sections. For example, in the applications of boundary detection between basic audio modalities (e.g. speech, music, and noise) and speaker change detection, the semantic level is low, and content coherence between shorter audio sections is measured. In an example scenario where audio sections include audio segments, the content coherence between the audio sections relates to the higher semantic level, and the content coherence between the audio segments relates to the lower semantic level.

For each audio segment $s_{i,l}$ in a first audio section, similarity calculator 101 determines a number K, K>0 of audio segments $s_{j,r}$ in a second audio section. The number K may be determined in advance or dynamically. The determined audio segments forms a subset $KNN(s_{i,l})$ of audio segments $s_{j,r}$ in the second audio section. Content similarity between audio segments $s_{i,l}$ and audio segments $s_{j,r}$ in $KNN(s_{i,l})$ is higher than content similarity between audio segments $s_{i,l}$ and all the other audio segments in the second audio section except for those in $KNN(s_{i,l})$. That is to say, in case that the audio segments in the second audio section are sorted in descending order of their content similarity with audio segment $s_{i,l}$, the first K audio segments form the set $KNN(s_{i,l})$. The term "content similarity" has the similar meaning with the term "content coherence". In the context that sections include segments, the term "content similarity" refers to content coherence between the segments, while the term "content coherence" refers to content coherence between the sections.

Figure 2:
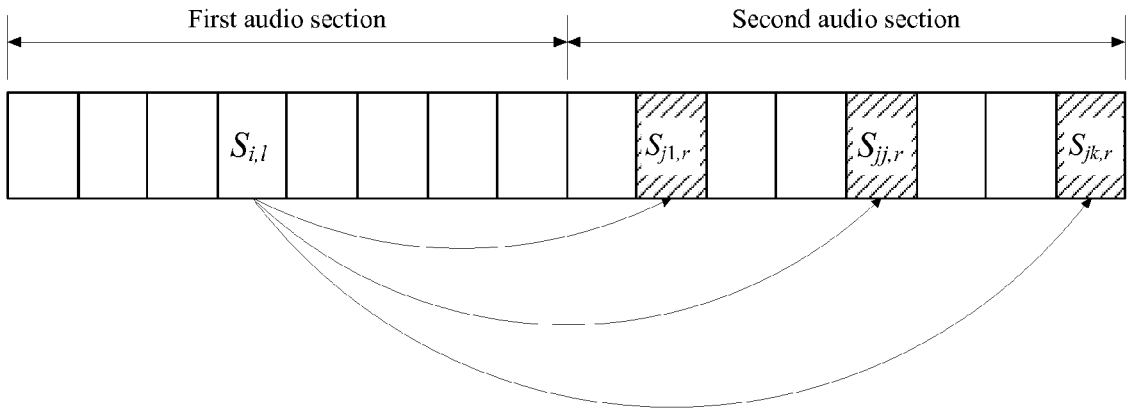
FIG. 2 is a schematic view for illustrating content similarity between an audio segment in a first audio section and a subset of audio segments in a second audio section.

FIG. 2 is a schematic view for illustrating the content similarity between an audio segment $s_{i,l}$ in the first audio section and the determined audio segments in $KNN(s_{i,l})$ corresponding to audio segment $s_{i,l}$ in the second audio section. In FIG. 2, blocks represent audio segments. Although the first audio section and the second audio section are illustrated as adjoining with each other, they may be separated or located in different audio signals, depending on the applications. Also depending on the applications, the first audio section and the second audio section may have the same length or different lengths. As illustrated in FIG. 2, for one audio segment $s_{i,l}$ in the first audio section, content similarity $S(s_{i,l}, s_{j,r})$ between audio segment $s_{i,l}$ and audio segments $s_{j,r}$, 0<j<M+1 in the second audio section may be calculated, where M is the length of the second audio section in units of segment. From the calculated content similarity $S(s_{i,l}, s_{j,r})$, 0<j<M+1, first K greatest content similarity $S(s_{i,l}, s_{j1,r})$ to $S(s_{i,l}, s_{jK,r})$, 0<j1, . . . , jK<M+1 are determined and audio segments $s_{j1,r}$ to $s_{jK,r}$ are determined to form the set $KNN(s_{i,l})$. Arrowed arcs in FIG. 2 illustrate the correspondence between audio segment $s_{i,l}$ and the determined audio segments $s_{j1,r}$ to $s_{jK,r}$ in $KNN(s_{i,l})$.

For each audio segment $s_{i,l}$ in the first audio section, similarity calculator 101 calculates an average $A(s_{i,l})$ of the content similarity $S(s_{i,l}, s_{j1,r})$ to $S(s_{i,l}, s_{jK,r})$ between audio segment $s_{i,l}$ and the determined audio segments $s_{j1,r}$ to $s_{jK,r}$ in $KNN(s_{i,l})$. The average $A(s_{i,l})$ may be a weighted or an unweighted one. In case of weighted average, the average $A(s_{i,l})$ may be calculated as $$A(s_{i,l}) = \sum_{s_{jk,r} \in KNN(s_{i,l})} w_{jk} S(s_{i,l}, s_{jk,r}) \tag{1}$$

where $w_{jk}$ is a weighting coefficient which may be 1/K, or alternatively, $w_{jk}$ may be larger if the distance between jk and i is smaller, and smaller if the distance is larger.

For the first audio section and the second audio section, coherence calculator 102 calculates content coherence Coh as an average of the averages $A(s_{i,l})$, 0<i<N+1, where N is the length of the first audio section in units of segment. The content coherence Coh may be calculated as $$Coh = \sum_{i=1}^{N} w_i A(s_{i,l}) \tag{2}$$

where N is the length of the first audio section in units of audio segment, and $w_i$ is a weighting coefficient which may be e.g., 1/N. The content coherence Coh may also be calculated as the minimum or the maximum of the averages $A(s_{i,l})$.

Various metric such as Hellinger distance, Square distance, Kullback-Leibler divergence, and Bayesian Information Criteria difference may be adopted to calculate the content similarity $S(s_{i,l}, s_{j,r})$. Also, the semantic affinity described in L. Lu and A. Hanjalic. "Text-Like Segmentation of General Audio for Content-Based Retrieval," *IEEE Trans. on Multimedia*, vol. 11, no. 4, 658-669, 2009 may be calculated as the content similarity $S(s_{i,l}, s_{j,r})$.

There may be various cases where contents of two audio sections are similar. For example, in a perfect case, any audio segment in the first audio section is similar to all the audio segments in the second audio section. In many other cases, however, any audio segment in the first audio section is similar to a portion of the audio segments in the second audio section. By calculating the content coherence Coh as an average of the content similarity between every segment $s_{i,l}$ in the first audio section and some audio segments, e.g., audio segments $s_{j,r}$ of KNN($s_{i,l}$) in the second audio section, it is possible to identify all these cases of similar contents.

In a further embodiment of apparatus 100, each content similarity $S(s_{i,l}, s_{j,r})$ between the audio segment $s_{i,l}$ in the first audio section and the audio segment $s_{j,r}$ of KNN($s_{i,l}$) may be calculated as content similarity between sequence $[s_{i,l}, \ldots, s_{i+L-1,l}]$ in the first audio section and sequence $[s_{j,r}, \ldots, s_{j+L-l,r}]$ in the second audio section, L>1. Various methods of calculating content similarity $S(s_{i,l}, s_{j,r})$ between two sequences of segments may be adopted. For example, the content similarity $S(s_{i,l}, s_{j,r})$ between sequence $[s_{i,l}, \ldots, s_{i+L-1,l}]$ and sequence $[s_{j,r}, \ldots, s_{j+L-1,r}]$ may be calculated as $$S(s_{i,l}, s_{j,r}) = \sum_{k=0}^{L-1} w_k S'(s_{i+k,l}, s_{j+k,r}) \tag{3}$$

where $w_k$ is a weighting coefficient may be set to, e.g., 1/(L−1).

Various metric such as Hellinger distance, Square distance, Kullback-Leibler divergence, and Bayesian Information Criteria difference may be adopted to calculate the content similarity $S'(s_{i,l}, s_{j,r})$. Also, the semantic affinity described in L. Lu and A. Hanjalic. "Text-Like Segmentation of General Audio for Content-Based Retrieval," *IEEE Trans. on Multimedia*, vol. 11, no. 4, 658-669, 2009 may be calculated as the content similarity $S'(s_{i,l}, s_{j,r})$.

In this way, temporal information may be accounted for by calculating the content similarity between two audio segments as that between two sequences starting from the two audio segments respectively. Consequently, a more accurate content coherence may be achieved.

Further, the content similarity $S(s_{i,l}, s_{j,r})$ between the sequence $[s_{i,l}, \ldots, s_{i+L-1,l}]$ and the sequence $[s_{j,r}, \ldots, s_{j+L-1,r}]$ may be calculated by applying a dynamic time warping (DTW) scheme or a dynamic programming (DP) scheme. The DTW scheme or the DP scheme is an algorithm for measuring the content similarity between two sequences which may vary in time or speed, in which the optimal matching path is searched, and the final content similarity is computed based on the optimal path. In this way, possible tempo/speed changes may be accounted for. Consequently, a more accurate content coherence may be achieved.

In an example of applying the DTW scheme, for a given sequence $[s_{i,l}, \ldots, s_{i+L-1,l}]$ in the first audio section, the best matched sequence $[s_{j,r}, \ldots, s_{j+L'-1,r}]$ may be determined in the second audio section by checking all the sequences starting from audio segment $s_{j,r}$ in the second audio section. Then the content similarity $S(s_{i,l}, s_{j,r})$ between the sequence $[s_{i,l}, \ldots, s_{i+L-1,l}]$ and the sequence $[s_{j,r}, \ldots, s_{j+L'-1,r}]$ may be calculated as $$S(s_{i,l}, s_{j,r}) = DTW([s_{i,l}, \ldots, s_{i+L-1,l}], [s_{j+L'-1,r}]) \tag{4}$$

where DTW([ ],[ ]) is a DTW-based similarity score which also considers the insertion and deletion costs.

In a further embodiment of apparatus 100, symmetric content coherence may be calculated. In this case, for each audio segment $s_{j,r}$ in the second audio section, similarity calculator 101 determines the number K of audio segments $s_{i,l}$ in the first audio section. The determined audio segments forms a set KNN($s_{j,r}$). Content similarity between audio segments $s_{j,r}$ and audio segments $s_{i,l}$ in KNN($s_{j,r}$) is higher than content similarity between audio segments $s_{j,r}$ and all the other audio segments in the first audio section except for those in KNN ($s_{j,r}$).

For each audio segment $s_{j,r}$ in the second audio section, similarity calculator 101 calculates an average $A(s_{j,r})$ of the content similarity $S(s_{j,r}, s_{i1,l})$ to $S(s_{j,r}, s_{iK,l})$ between audio segment $s_{j,r}$ and the determined audio segments $s_{i1,l}$ to $s_{iK,l}$ in KNN($s_{j,r}$). The average $A(s_{j,r})$ may be a weighted or an un-weighted one.

For the first audio section and the second audio section, coherence calculator 102 calculates content coherence Coh' as an average of the averages $A(s_{j,r})$, 0<j<N+1, where N is the length of the second audio section in units of segment. The content coherence Coh' may also be calculated as the minimum or the maximum of the averages $A(s_{i,l})$. Further, coherence calculator is 102 calculates a final symmetric content coherence based on the content coherence Coh and the content coherence Coh'.

Figure 3:
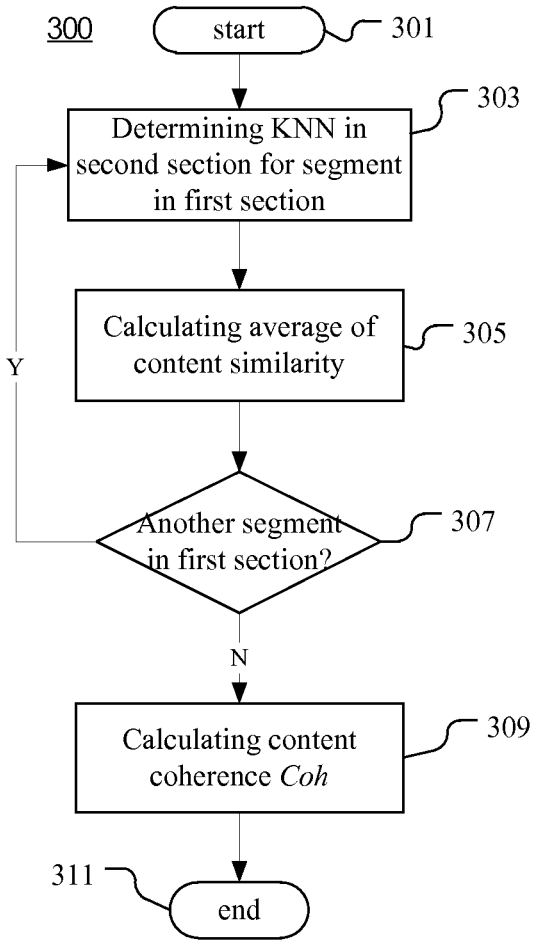
FIG. 3 is a flow chart illustrating an example method of measuring content coherence according to an embodiment of the present invention.

FIG. 3 is a flow chart illustrating an example method 300 of measuring content coherence according to an embodiment of the present invention.

In method 300, a predetermined processing is performed on the audio signal according to measured content coherence. The predetermined processing depends on the applications. The length of the audio sections may depend on the semantic level of object contents to be segmented or grouped.

As illustrated in FIG. 3, method 300 starts from step 301. At step 303, for one audio segment $s_{i,l}$ in a first audio section, a number K, K>0 of audio segments $s_{j,r}$ in a second audio section are determined. The number K may be determined in advance or dynamically. The determined audio segments forms a set KNN($s_{i,l}$). Content similarity between audio segments $s_{i,l}$ and audio segments $s_{j,r}$ in KNN($s_{i,l}$) is higher than content similarity between audio segments $s_{i,l}$ and all the other audio segments in the second audio section except for those in KNN($s_{i,l}$).

At step 305, for the audio segment $s_{i,l}$, an average $A(s_{i,l})$ of the content similarity $S(s_{i,l}, s_{j1,r})$ to $S(s_{i,l}, s_{jK,r})$ between audio segment $s_{i,l}$ and the determined audio segments $s_{j1,r}$ to $s_{jK,r}$ in KNN($s_{i,l}$) is calculated. The average $A(s_{i,l})$ may be a weighted or an un-weighted one.

At step 307, it is determined whether there is another audio segment $s_{k,l}$ not processed yet in the first audio section. If yes, method 300 returns to step 303 to calculate another average $A(s_{k,l})$. If no, method 300 proceeds to step 309.

At step 309, for the first audio section and the second audio section, content coherence Coh is calculated as an average of the averages $A(s_{i,l})$, 0<i<N+1, where N is the length of the first audio section in units of segment. The content coherence Coh may also be calculated as the minimum or the maximum of the averages $A(s_{i,l})$.

Method 300 ends at step 311.

In a further embodiment of method 300, each content similarity $S(s_{i,l}, s_{j,r})$ between the audio segment $s_{i,l}$ in the first audio section and the audio segment $s_{j,r}$ of KNN($s_{i,l}$) may be calculated as content similarity between sequence $[s_{i,l}, \ldots, s_{i+L-1,l}]$ in the first audio section and sequence $[s_{i,l}, \ldots, s_{i+L-1,l}]$ in the second audio section, L>1.

Further, the content similarity $S(s_{i,l}, s_{j,r})$ between the sequence $[s_{i,l}, \ldots, s_{i+L-1,l}]$ and the sequence $[s_{i,l}, \ldots, s_{i+L-1,l}]$ may be calculated by applying a dynamic time warping (DTW) scheme or a dynamic programming (DP) scheme. In an example of applying the DTW scheme, for a given sequence $[s_{i,l}, \ldots, s_{i+L-1,l}]$ in the first audio section, the best matched sequence $[s_{i,l}, \ldots, s_{i+L-1,l}]$ may be determined in the second audio section by checking all the sequences starting from audio segment $s_{j,r}$ in the second audio section. Then the content similarity $S(s_{i,l}, s_{j,r})$ between the sequence $[s_{i,l}, \ldots, s_{i+L-1,l}]$ and the sequence $[s_{i,l}, \ldots, s_{i+L-1,l}]$ may be calculated by Eq. (4).

Figure 4:
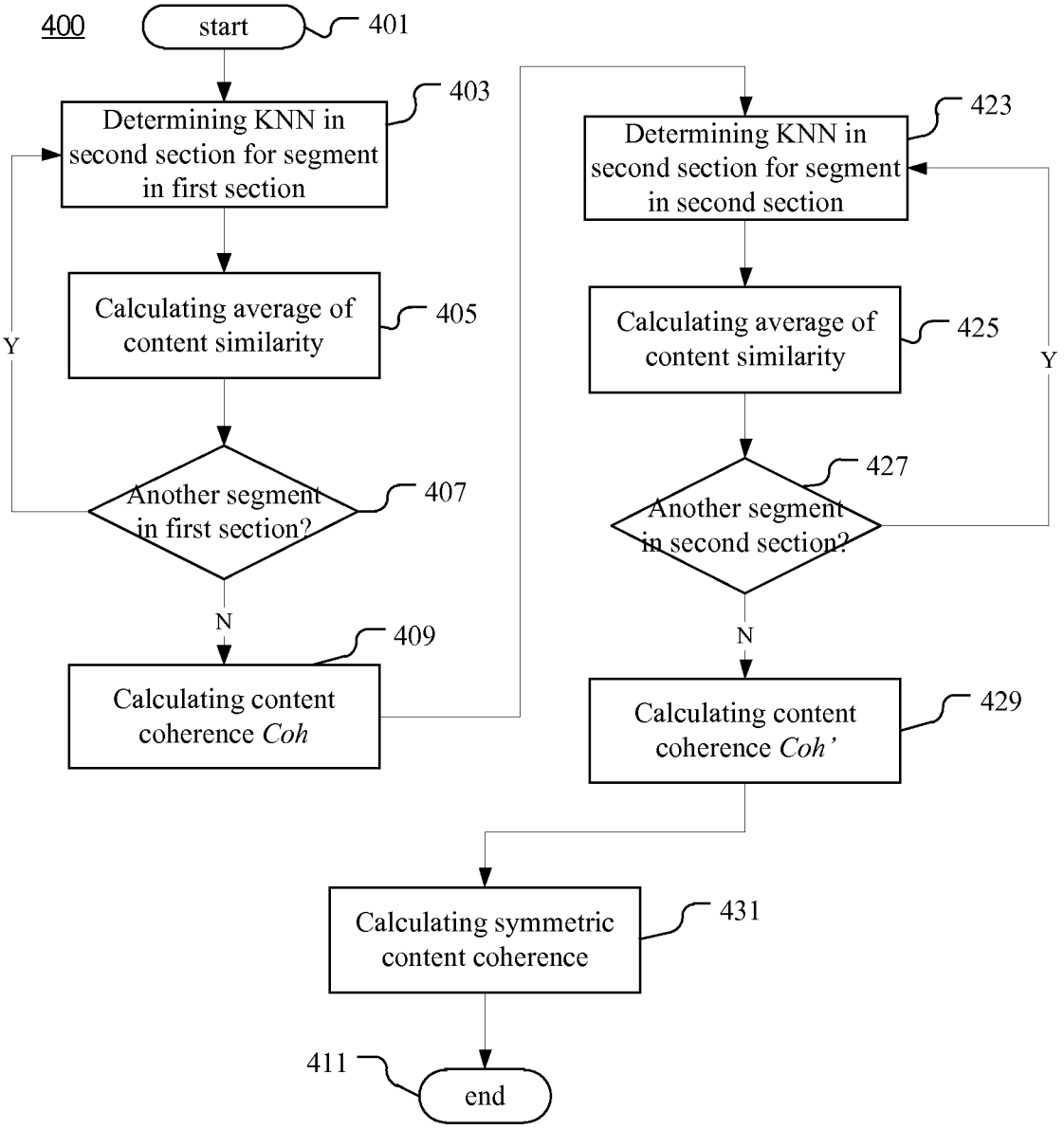
FIG. 4 is a flow chart illustrating an example method of measuring content coherence according to a further embodiment of the method in FIG. 3.

FIG. 4 is a flow chart illustrating an example method 400 of measuring content coherence according to a further embodiment of method 300.

In method 400, steps 401, 403, 405, 409 and 411 have the same functions with steps 301, 303, 305, 309 and 311 respectively, and will not be described in detail herein.

After step 409, method 400 proceeds to step 423.

At step 423, for one audio segment $s_{j,r}$ in the second audio section, the number K of audio segments $s_{i,l}$ in the first audio section are determined. The determined audio segments forms a set $KNN(s_{j,r})$. Content similarity between audio segments $s_{j,r}$ and audio segments $s_{i,l}$ in $KNN(s_{j,r})$ is higher than content similarity between audio segments $s_{j,r}$ and all the other audio segments in the first audio section except for those in $KNN(s_{j,r})$.

At step 425, for the audio segment $s_{j,r}$, an average $A(s_{j,r})$ of the content similarity $S(s_{j,r}, s_{i1,l})$ to $S(s_{j,r}, s_{iK,l})$ between audio segment $s_{j,r}$ and the determined audio segments $s_{i1,l}$ to $s_{iK,l}$ in $KNN(s_{j,r})$ is calculated. The average $A(s_{j,r})$ may be a weighted or an un-weighted one.

At step 427, it is determined whether there is another audio segment $s_{k,r}$ not processed yet in the second audio section. If yes, method 400 returns to step 423 to calculate another average $A(s_{k,r})$. If no, method 400 proceeds to step 429.

At step 429, for the first audio section and the second audio section, content coherence Coh' is calculated as an average of the averages $A(s_{j,r})$, $0<j<N+1$, where N is the length of the second audio section in units of segment. The content coherence Coh' may also be calculated as the minimum or the maximum of the averages $A(s_{i,l})$.

At step 431, a final symmetric content coherence is calculated based on the content coherence Coh and the content coherence Coh'. Then step 400 ends at step 411.

Figure 5:
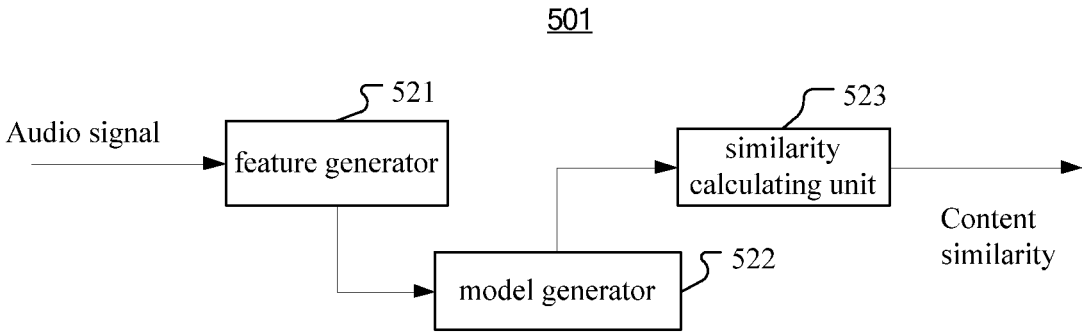
FIG. 5 is a block diagram illustrating an example of the similarity calculator according to an embodiment of the present invention.

FIG. 5 is a block diagram illustrating an example of similarity calculator 501 according to the embodiment.

As illustrated in FIG. 5, similarity calculator 501 includes a feature generator 521, a model generator 522 and a similarity calculating unit 523.

For the content similarity to be calculated, feature generator 521 extracts first feature vectors from the associated audio segments.

Model generator 522 generates statistical models for calculating the content similarity from the feature vectors.

Similarity calculating unit 523 calculates the content similarity based on the generated statistical models.

In calculating the content similarity between two audio segments, various metric may be adopted, including but not limited to KLD, Bayesian Information Criteria (BIC), Hellinger distance, Square distance, Euclidean distance, cosine distance, and Mahalonobis distance. The calculation of the metric may involve generating statistical models from the audio segments and calculating similarity between the statistical models. The statistical models may be based on the Gaussian distribution.

It is also possible to extract feature vectors where all the feature values in the same feature vector are non-negative and have a sum of one from the audio segments (called as simplex feature vectors). This kind of feature vectors complies with the Dirichlet distribution more than the Gaussian distribution. Examples of the simplex feature vectors include, but not limited to, sub-band feature vector (formed of energy ratios of all the sub-bands with respect to the entire frame energy) and chroma feature which is generally defined as a 12-dimensional vector where each dimension corresponds to the intensity of a semitone class.

In a further embodiment of similarity calculator 501, for the content similarity to be calculated between two audio segments, feature generator 521 extracts simplex feature vectors from the audio segments. The simplex feature vectors are supplied to model generator 522.

In response, model generator 522 generates statistical models for calculating the content similarity based on the Dirichlet distribution from the simplex feature vectors. The statistical models are supplied to similarity calculating unit 523.

The Dirichlet distribution of a feature vector x (order $d\geq 2$) with parameters $\alpha_l, \ldots, \alpha_d>0$ may be expressed as $$Dir(\alpha) = p(x \mid \alpha) = \frac{\Gamma\left(\sum_{k=1}^{d} \alpha_k\right)}{\prod_{k=1}^{d} \Gamma(\alpha_k)} \prod_{k=1}^{d} x_k^{\alpha_k - 1} \tag{5}$$

where Γ( ) is a gamma function, and the feature vector x satisfies the following simplex property, $$x_k \geq 0, \Sigma_{k=1}^{d} x_k = 1 \tag{6}$$

The simplex property may be achieved by feature normalization, e.g. L1 or L2 normalization.

Various methods may be adopted to estimate parameters of the statistical models. For example, the parameters of the Dirichlet distribution may be estimated by a maximum likelihood (ML) method. Similarly, Dirichlet mixture model (DMM) may also be estimated to deal with more complex feature distributions, which is inherently a mixture of multiple Dirichlet models, as $$DMM(\alpha) = \sum_{m=1}^{M} \omega_m \frac{\Gamma\left(\sum_{k=1}^{d} \alpha_{mk}\right)}{\prod_{k=1}^{d} \Gamma(\alpha_{mk})} \prod_{k=1}^{d} x_k^{\alpha_{mk} - 1} \tag{7}$$

In response, similarity calculating unit 523 calculates the content similarity based on the generated statistical models.

In a further example of similarity calculating unit 523, the Hellinger distance is adopted to calculate the content similarity. In this case, the Hellinger distance $D(\alpha,\beta)$ between two Dirichlet distributions $Dir(\alpha)$ and $Dir(\beta)$ generated from two audio segments respectively may be calculated as $$D(\alpha, \beta) = \int \left(\sqrt{p(x \mid a)} - \sqrt{p(x \mid \beta)}\right)^2 dx = 2 - 2\int \sqrt{p(x \mid a) p(x \mid \beta)}\, dx = 2 - 2 \times \left[\frac{\Gamma\left(\sum_{k=1}^{d} \alpha_k\right)}{\prod_{k=1}^{d} \Gamma(\alpha_k)} \times \frac{\Gamma\left(\sum_{k=1}^{d} \beta_k\right)}{\prod_{k=1}^{d} \Gamma(\beta_k)}\right]^{\frac{1}{2}} \times \frac{\prod_{k=1}^{d} \Gamma\left(\frac{\alpha_k + \beta_k}{2}\right)}{\Gamma\left(\sum_{k=1}^{d} \frac{\alpha_k + \beta_k}{2}\right)} \tag{8}$$

Alternatively, the square distance is adopted to calculate the content similarity. In this case, the square distance $D_s$ between two Dirichlet distributions $Dir(\alpha)$ and $Dir(\beta)$ generated from two audio segments respectively may be calculated as $$D_s = \int (p(x|\alpha) - p(x|\beta))^2 dx \tag{9}$$

$$= \int \left( \frac{\Gamma\left(\sum_{k=1}^{d} \alpha_k\right)}{\prod_{k=1}^{d} \Gamma(\alpha_k)} \prod_{k=1}^{d} x_k^{\alpha_k - 1} - \frac{\Gamma\left(\sum_{k=1}^{d} \beta_k\right)}{\prod_{k=1}^{d} \Gamma(\beta_k)} \prod_{k=1}^{d} x_k^{\beta_k - 1} \right)^2 dx$$

$$= T_1^2 \frac{\prod_{k=1}^{d} \Gamma(2\alpha_k - 1)}{\Gamma\left(\sum_{k=1}^{d} (2\alpha_k - 1)\right)} - 2T_1T_2 \frac{\prod_{k=1}^{d} (\alpha_k + \beta_k - 1)}{\Gamma\left(\sum_{k=1}^{d} (\alpha_k + \beta_k - 1)\right)} + T_2^2 \frac{\prod_{k=1}^{d} (2\beta_k - 1)}{\Gamma\left(\sum_{k=1}^{d} (2\beta_k - 1)\right)}$$

where $T_1 = \frac{\Gamma\left(\sum_{k=1}^{d} \alpha_k\right)}{\prod_{k=1}^{d} \Gamma(\alpha_k)}$ and $T_2 = \frac{\Gamma\left(\sum_{k=1}^{d} \beta_k\right)}{\prod_{k=1}^{d} \Gamma(\beta_k)}$.

Feature vectors not having the simplex property may also be extracted, for example, in case of adopting features such as Mel-frequency Cepstral Coefficient (MFCC), spectral flux and brightness. It is also possible to convert these non-simplex feature vectors into simplex feature vectors.

In a further example of similarity calculator 501, feature generator 521 may extract non-simplex feature vectors from the audio segments. For each of the non-simplex feature vectors, feature generator 521 may calculate an amount for measuring a relation between the non-simplex feature vector and each of reference vectors. The reference vectors are also non-simplex feature vectors. Supposing there are M reference vectors $z_j$, j=1, . . . , M is equal to the number of dimensions of the simplex features vectors to be generated by feature generator 521. An amount $v_j$ for measuring the relation between one non-simplex feature vector and one reference vector refers to the degree of relevance between the non-simplex feature vector and the reference vector. The relation may be measured in various characteristics obtained by observing the reference vector with respect to the non-simplex feature vector. All the amounts corresponding to the non-simplex feature vectors may be normalized and form the simplex feature vector v.

For example, the relation may be one of the followings:

1) distance between the non-simplex feature vector and the reference vector;

2) correlation or inter-product between the non-simplex feature vector and the reference vector; and 3) posterior probability of the reference vector with the non-simplex feature vector as the relevant evidence.

In case of the distance, it is possible to calculate the amount $v_j$ as the distance between the non-simplex feature vector x and the reference vector $z_j$, and then normalize the obtained distances to 1, that is $$v_j = \frac{\|x - z_j\|^2}{\sum_{j=1}^{M} \|x - z_j\|^2} \tag{10}$$

where || || represents Euclidean distance.

Statistical or probabilistic methods may be also applied to measure the relation. In case of posterior probability, supposing that each reference vector is modeled by some kinds of distribution, the simplex feature vector may be calculated as $$v = [p(z_1|x), p(z_2|x), \ldots, p(z_M|x)] \tag{11}$$

where $p(x|z_j)$ represents the probability of the non-simplex feature vector x given the reference vector $z_j$. The probability $p(z_j|x)$ may be calculated as the following by assuming that the prior $p(z_j)$ is uniformly distributed, $$p(z_j|x) = \frac{p(x|z_j)p(z_j)}{p(x)} = \frac{p(x|z_j)p(z_j)}{\sum_{j=1}^{M} p(x|z_j)p(z_j)} = \frac{p(x|z_j)}{\sum_{j=1}^{M} p(x|z_j)} \tag{12}$$

There may be alternative ways to generate the reference vectors.

For example, one method is to randomly generate a number of vectors as the reference vectors, similar to the method of Random Projection.

For another example, one method is unsupervised clustering where training vectors extracted from training samples are grouped into clusters and the reference vectors are calculated to represent the clusters respectively. In this way, each obtained cluster may be considered as a reference vector and represented by its center or a distribution (e.g., a Gaussian by using its mean and covariance). Various clustering methods, such as k-means and spectral clustering, may be adopted.

For another example, one method is supervised modeling where each reference vector may be manually defined and learned from a set of manually collected data.

For another example, one method is eigen-decomposition where the reference vectors are calculated as eigenvectors of a matrix with the training vectors as its rows. General statistical approaches such as principle component analysis (PCA), independent component analysis (ICA), and linear discriminant analysis (LDA) may be adopted.

Figure 6:
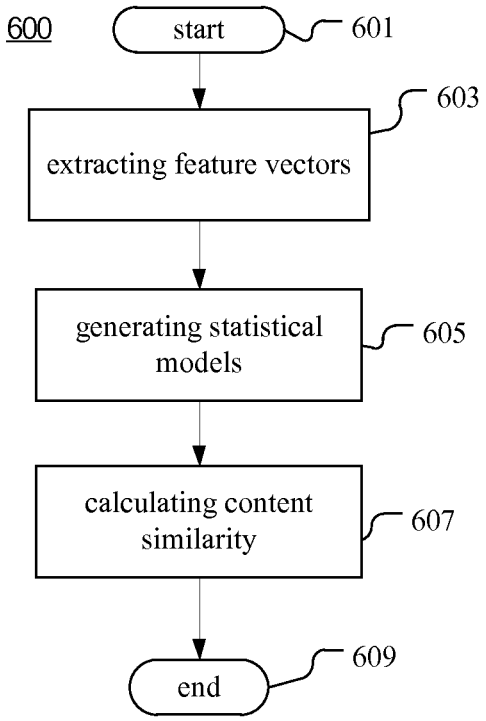
FIG. 6 is a flow chart for illustrating an example method of calculating the content similarity by adopting statistical models.

FIG. 6 is a flow chart for illustrating an example method 600 of calculating the content similarity by adopting statistical models.

As illustrated in FIG. 6, method 600 starts from step 601. At step 603, for the content similarity to be calculated between two audio segments, feature vectors are extracted from the audio segments. At step 605, statistical models for calculating the content similarity are generated from the feature vectors. At step 607, the content similarity is calculated based on the generated statistical models. Method 600 ends at step 609.

In a further embodiment of method 600, simplex feature vectors are extracted from the audio segments at step 603.

At step 605, the statistical models based on the Dirichlet distribution are generated from the simplex feature vectors.

In a further example of method 600, the Hellinger distance is adopted to calculate the content similarity. Alternatively, the square distance is adopted to calculate the content similarity.

In a further example of method 600, non-simplex feature vectors are extracted from the audio segments. For each of the non-simplex feature vectors, an amount for measuring a relation between the non-simplex feature vector and each of reference vectors is calculated. All the amounts corresponding to the non-simplex feature vectors may be normalized and form the simplex feature vector v. More details about the relation and the reference vectors have been described in connection with FIG. 5, and will not be described in detail here.

While various distributions can be applied to measure content coherence, the metrics with regard to different distributions can be combined together. Various combination ways are possible, from simply using a weighted average to using statistical models.

The criterion for calculating the content coherence may be not limited to that described in connection with FIG. 2. Other criteria may also be adopted, for example, the criterion described in L. Lu and A. Hanjalic. "Text-Like Segmentation of General Audio for Content-Based Retrieval," *IEEE Trans. on Multimedia*, vol. 11, no. 4, 658-669, 2009. In this case, methods of calculating the content similarity described in connection with FIG. 5 and FIG. 6 may be adopted.

Figure 7:
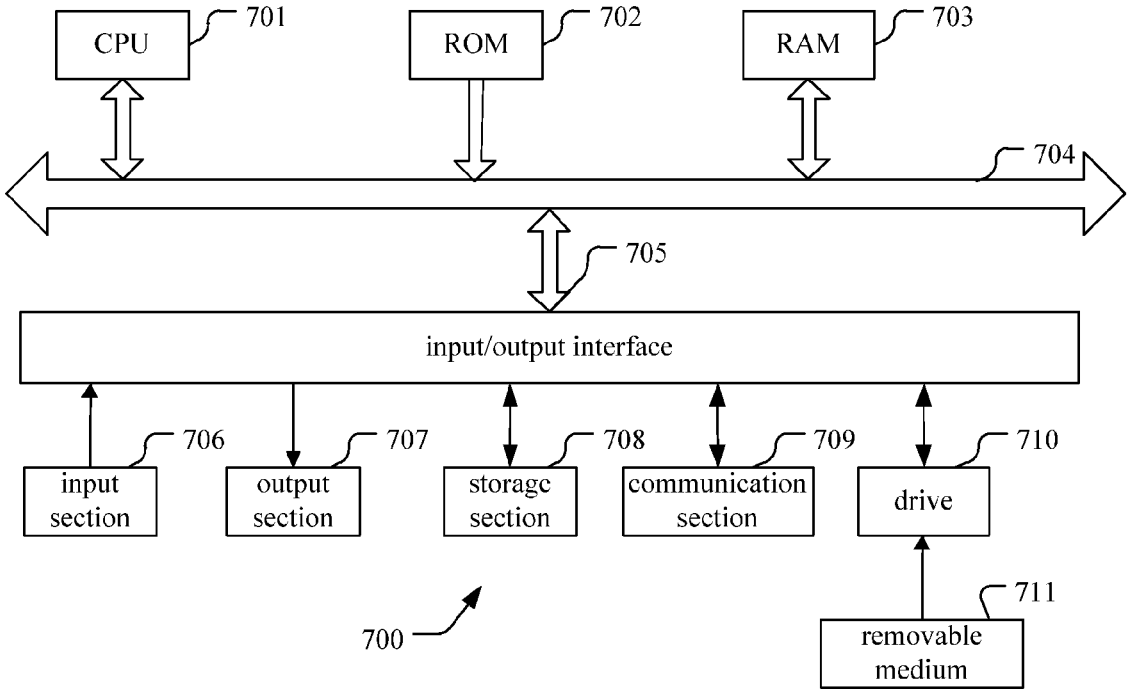
FIG. 7 is a block diagram illustrating an exemplary system for implementing embodiments of the present invention.

FIG. 7 is a block diagram illustrating an exemplary system for implementing the aspects of the present invention.

In FIG. 7, a central processing unit (CPU) 701 performs various processes in accordance with a program stored in a read only memory (ROM) 702 or a program loaded from a storage section 708 to a random access memory (RAM) 703. In the RAM 703, data required when the CPU 701 performs the various processes or the like is also stored as required.

The CPU 701, the ROM 702 and the RAM 703 are connected to one another via a bus 704. An input/output interface 705 is also connected to the bus 704.

The following components are connected to the input/output interface 705: an input section 706 including a keyboard, a mouse, or the like; an output section 707 including a display such as a cathode ray tube (CRT), a liquid crystal display (LCD), or the like, and a loudspeaker or the like; the storage section 708 including a hard disk or the like; and a communication section 709 including a network interface card such as a LAN card, a modem, or the like. The communication section 709 performs a communication process via the network such as the internet.

A drive 710 is also connected to the input/output interface 705 as required. A removable medium 711, such as a magnetic disk, an optical disk, a magneto—optical disk, a semiconductor memory, or the like, is mounted on the drive 710 as required, so that a computer program read therefrom is installed into the storage section 708 as required.

In the case where the above—described steps and processes are implemented by the software, the program that constitutes the software is installed from the network such as the internet or the storage medium such as the removable medium 711.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The following exemplary embodiments (each an "EE") are described.

EE 1. A method of measuring content coherence between a first audio section and a second audio section, comprising:

for each of audio segments in the first audio section, determining a predetermined number of audio segments in the second audio section, wherein content similarity between the audio segment in the first audio section and the determined audio segments is higher than that between the audio segment in the first audio section and all the other audio segments in the second audio section; and calculating an average of the content similarity between the audio segment in the first audio section and the determined audio segments; and calculating first content coherence as an average, the minimum or the maximum of the averages calculated for the audio segments in the first audio section.

EE 2. The method according to EE 1, further comprising:

for each of the audio segments in the second audio section, determining a predetermined number of audio segments in the first audio section, wherein content similarity between the audio segment in the second audio section and the determined audio segments is higher than that between the audio segment in the second audio section and all the other audio segments in the first audio section; and calculating an average of the content similarity between the audio segment in the second audio section and the determined audio segments;

calculating second content coherence as an average, the minimum or the maximum of the averages calculated for the audio segments in the second audio section;

calculating symmetric content coherence based on the first content coherence and the second content coherence.

EE 3. The method according to EE 1 or 2, wherein each of the content similarity $S(s_{i,l}, s_{j,r})$ between the audio segment $s_{i,l}$ in the first audio section and the determined audio segments $s_{j,r}$ is calculated as content similarity between sequence $[s_{i,l}, \ldots, s_{i+L-1,l}]$ in the first audio section and sequence $[s_{i,l}, \ldots, s_{i+L-1,l}]$ in the second audio section, $L>1$.

EE 4. The method according to EE 3, wherein the content similarity between the sequences is calculated by applying a dynamic time warping scheme or a dynamic programming scheme.

EE 5. The method according to EE 1 or 2, wherein the content similarity between two audio segments is calculated by extracting first feature vectors from the audio segments;

generating statistical models for calculating the content similarity from the feature vectors; and calculating the content similarity based on the generated statistical models.

EE 6. The method according to EE 5, wherein all the feature values in each of the first feature vectors are non-negative and the sum of the feature values is one, and the statistical models are based on Dirichlet distribution.

EE 7. The method according to EE 6, wherein the extracting comprises:

extracting second feature vectors from the audio segments; and for each of the second feature vectors, calculating an amount for measuring a relation between the second feature vector and each of reference vectors, wherein all the amounts corresponding to the second feature vectors form one of the first feature vectors.

EE 8. The method according to EE 7, wherein the reference vectors are determined through one of the following methods:

random generating method where the reference vectors are randomly generated;

unsupervised clustering method where training vectors extracted from training samples are grouped into clusters and the reference vectors are calculated to represent the clusters respectively;

supervised modeling method where the reference vectors are manually defined and learned from the training vectors; and eigen-decomposition method where the reference vectors are calculated as eigenvectors of a matrix with the training vectors as its rows.

EE 9. The method according to EE 7, wherein the relation between the second feature vectors and each of the reference vectors is measured by one of the following amounts:

distance between the second feature vector and the reference vector;

correlation between the second feature vector and the reference vector;

inter product between the second feature vector and the reference vector; and posterior probability of the reference vector with the second feature vector as the relevant evidence.

EE 10. The method according to EE 9, wherein the distance $v_j$ between the second feature vector x and the reference vector $z_j$ is calculated as $$v_j = \frac{\|x - z_j\|^2}{\sum_{j=1}^{M} \|x - z_j\|^2},$$

where M is the number of the reference vectors, $\| \|$ represents Euclidean distance.

EE 11. The method according to EE 9, wherein the posterior probability $p(z_j|x)$ of the reference vector $z_j$ with the second feature vector x as the relevant evidence is calculated as $$p(z_j \mid x) = \frac{p(x \mid z_j)p(z_j)}{\sum_{j=1}^{M} p(x \mid z_j)p(z_j)},$$

where $p(x|z_j)$ represents the probability of the second feature vector x given the reference vector $z_j$, M is the number of the reference vectors, $p(z_j)$ is the prior distribution.

EE 12. The method according to EE 6, wherein the parameters of the statistical models are estimated by a maximum likelihood method.

EE 13. The method according to EE 6, wherein the statistical models are based on one or more Dirichlet distributions.

EE 14. The method according to EE 6, wherein the content similarity is measured by one of the following metric:

Hellinger distance;

Square distance;

Kullback-Leibler divergence; and

Bayesian Information Criteria difference.

EE 15. The method according to EE 14, wherein the Hettinger distance $D(\alpha,\beta)$ is calculated as $$D(\alpha, \beta) = 2 - 2 \times \left[ \frac{\Gamma\left(\sum_{k=1}^{d} \alpha_k\right)}{\prod_{k=1}^{d} \Gamma(\alpha_k)} \times \frac{\Gamma\left(\sum_{k=1}^{d} \beta_k\right)}{\prod_{k=1}^{d} \Gamma(\beta_k)} \right]^{\frac{1}{2}} \times \frac{\prod_{k=1}^{d} \Gamma\left(\frac{\alpha_k + \beta_k}{2}\right)}{\Gamma\left(\sum_{k=1}^{d} \frac{\alpha_k + \beta_k}{2}\right)},$$

where $\alpha_1, \ldots, \alpha_d > 0$ are parameters of one of the statistical models and $\beta_1, \ldots, \beta_d > 0$ are parameters of another of the statistical models, $d \geq 2$ is the number of dimensions of the first feature vectors, and $\Gamma(\ )$ is a gamma function.

EE 16. The method according to EE 14, wherein the Square distance $D_s$ is calculated as $$D_s = T_1^2 \frac{\prod_{k=1}^{d} \Gamma(2\alpha_k - 1)}{\Gamma\left(\sum_{k=1}^{d} (2\alpha_k - 1)\right)} - 2T_1T_2 \frac{\prod_{k=1}^{d} (\alpha_k + \beta_k - 1)}{\Gamma\left(\sum_{k=1}^{d} (\alpha_k + \beta_k - 1)\right)} + T_2^2 \frac{\prod_{k=1}^{d} (2\beta_k - 1)}{\Gamma\left(\sum_{k=1}^{d} (2\beta_k - 1)\right)},$$

where $$T_1 = \frac{\Gamma\left(\sum_{k=1}^{d} \alpha_k\right)}{\prod_{k=1}^{d} \Gamma(\alpha_k)}, \quad T_2 = \frac{\Gamma\left(\sum_{k=1}^{d} \beta_k\right)}{\prod_{k=1}^{d} \Gamma(\beta_k)},$$

$\alpha_1, \ldots, \alpha_d > 0$ are parameters of one of the statistical models and $\beta_1, \ldots, \beta_d > 0$ are parameters of another of the statistical models, $d \geq 2$ is the number of dimensions of the first feature vectors, and $\Gamma(\ )$ is a gamma function.

EE 17. An apparatus for measuring content coherence between a first audio section and a second audio section, comprising:

a similarity calculator which, for each of audio segments in the first audio section, determines a predetermined number of audio segments in the second audio section, wherein content similarity between the audio segment in the first audio section and the determined audio segments is higher than that between the audio segment in the first audio section and all the other audio segments in the second audio section; and calculates an average of the content similarity between the audio segment in the first audio section and the determined audio segments; and a coherence calculator which calculates first content coherence as an average, the minimum or the maximum of the averages calculated for the audio segments in the first audio section.

EE 18. The apparatus according to EE 17, wherein the similarity calculator is further configured to, for each of the audio segments in the second audio section, determine a predetermined number of audio segments in the first audio section, wherein content similarity between the audio segment in the second audio section and the determined audio segments is higher than that between the audio segment in the second audio section and all the other audio segments in the first audio section; and calculate an average of the content similarity between the audio segment in the second audio section and the determined audio segments, and wherein the coherence calculator is further configured to calculate second content coherence as an average, the minimum or the maximum of the averages calculated for the audio segments in the second audio section, and calculate symmetric content coherence based on the first content coherence and the second content coherence.

EE 19. The apparatus according to EE 17 or 18, wherein each of the content similarity $S(s_{i,l}, s_{j,r})$ between the audio segment $s_{i,l}$ in the first audio section and the determined audio segments $s_{j,r}$ is calculated as content similarity between sequence $[s_{i,l}, \ldots, s_{i+L-1,l}]$ in the first audio section and sequence $[s_{i,l}, \ldots, s_{i+L-1,l}]$ in the second audio section, L>1.

EE 20. The apparatus according to EE 19, wherein the content similarity between the sequences is calculated by applying a dynamic time warping scheme or a dynamic programming scheme.

EE 21. The apparatus according to EE 17 or 18, wherein the similarity calculator comprises:

a feature generator which, for each of the content similarity, extracts first feature vectors from the associated audio segments;

a model generator which generates statistical models for calculating each of the content similarity from the feature vectors; and a similarity calculating unit which calculates the content similarity based on the generated statistical models.

EE 22. The apparatus according to EE 21, wherein all the feature values in each of the first feature vectors are non-negative and the sum of the feature values is one, and the statistical models are based on Dirichlet distribution.

EE 23. The apparatus according to EE 22, wherein the feature generator is further configured to extract second feature vectors from the audio segments; and for each of the second feature vectors, calculate an amount for measuring a relation between the second feature vector and each of reference vectors, wherein all the amounts corresponding to the second feature vectors form one of the first feature vectors.

EE 24. The apparatus according to EE 23, wherein the reference vectors are determined through one of the following methods:

random generating method where the reference vectors are randomly generated;

unsupervised clustering method where training vectors extracted from training samples are grouped into clusters and the reference vectors are calculated to represent the clusters respectively;

supervised modeling method where in the reference vectors are manually defined and learned from the training vectors; and eigen-decomposition method where the reference vectors are calculated as eigenvectors of a matrix with the training vectors as its rows.

EE 25. The apparatus according to EE 23, wherein the relation between the second feature vectors and each of the reference vectors is measured by one of the following amounts:

distance between the second feature vector and the reference vector;

correlation between the second feature vector and the reference vector;

inter product between the second feature vector and the reference vector; and posterior probability of the reference vector with the second feature vector as the relevant evidence.

EE 26. The apparatus according to EE 25, wherein the distance $v_j$ between the second feature vector x and the reference vector $z_j$ is calculated as $$v_j = \frac{\|x - z_j\|^2}{\sum_{j=1}^{M} \|x - z_j\|^2},$$

where M is the number of the reference vectors, $\| \|$ represents Euclidean distance.

EE 27. The apparatus according to EE 25, wherein the posterior probability $p(z_j|x)$ of the reference vector $z_j$ with the second feature vector x as the relevant evidence is calculated as $$p(z_j \mid x) = \frac{p(x \mid z_j)p(z_j)}{\sum_{j=1}^{M} p(x \mid z_j)p(z_j)},$$

where $p(x|z_j)$ represents the probability of the second feature vector x given the reference vector $z_j$, M is the number of the reference vectors, $p(z_j)$ is the prior distribution EE 28. The apparatus according to EE 22, wherein the parameters of the statistical models are estimated by a maximum likelihood method.

EE 29. The apparatus according to EE 22, wherein the statistical models are based on one or more Dirichlet distributions.

EE 30. The apparatus according to EE 22, wherein the content similarity is measured by one of the following metric:

Hellinger distance;

Square distance;

Kullback-Leibler divergence; and

Bayesian Information Criteria difference.

EE 31. The apparatus according to EE 30, wherein the Hellinger distance $D(\alpha,\beta)$ is calculated as $$D(\alpha, \beta) = 2 - 2 \times \left[ \frac{\Gamma\left(\sum_{k=1}^{d} \alpha_k\right)}{\prod_{k=1}^{d} \Gamma(\alpha_k)} \times \frac{\Gamma\left(\sum_{k=1}^{d} \beta_k\right)}{\prod_{k=1}^{d} \Gamma(\beta_k)} \right]^{\frac{1}{2}} \times \frac{\prod_{k=1}^{d} \Gamma\left(\frac{\alpha_k + \beta_k}{2}\right)}{\Gamma\left(\sum_{k=1}^{d} \frac{\alpha_k + \beta_k}{2}\right)},$$

where $\alpha_1, \alpha_d > 0$ are parameters of one of the statistical models and $\beta_1, \ldots, \beta_d > 0$ are parameters of another of the statistical models, $d \geq 2$ is the number of dimensions of the first feature vectors, and $\Gamma(\ )$ is a gamma function.

EE 32. The apparatus according to EE 30, wherein the Square distance $D_s$ is calculated as $$D_s = T_1^2 \frac{\prod_{k=1}^{d} \Gamma(2\alpha_k - 1)}{\Gamma\left(\sum_{k=1}^{d} (2\alpha_k - 1)\right)} - 2T_1T_2 \frac{\prod_{k=1}^{d} (\alpha_k + \beta_k - 1)}{\Gamma\left(\sum_{k=1}^{d} (\alpha_k + \beta_k - 1)\right)} + T_2^2 \frac{\prod_{k=1}^{d} (2\beta_k - 1)}{\Gamma\left(\sum_{k=1}^{d} (2\beta_k - 1)\right)},$$

where $$T_1 = \frac{\Gamma\left(\sum_{k=1}^{d} \alpha_k\right)}{\prod_{k=1}^{d} \Gamma(\alpha_k)}, \quad T_2 = \frac{\Gamma\left(\sum_{k=1}^{d} \beta_k\right)}{\prod_{k=1}^{d} \Gamma(\beta_k)},$$

$\alpha_1, \ldots, \alpha_d > 0$ are parameters of one of the statistical models and $\beta_1, \ldots, \beta_d > 0$ are parameters of another of the statistical models, $d \geq 2$ is the number of dimensions of the first feature vectors, and $\Gamma(\ )$ is a gamma function.

EE 33. A method of measuring content similarity between two audio segments, comprising:

extracting first feature vectors from the audio segments, wherein all the feature values in each of the first feature vectors are non-negative and normalized so that the sum of the feature values is one;

generating statistical models for calculating the content similarity based on Dirichlet distribution from the feature vectors; and calculating the content similarity based on the generated statistical models.

EE 34. The method according to EE 33, wherein the extracting comprises:

extracting second feature vectors from the audio segments; and for each of the second feature vectors, calculating an amount for measuring a relation between the second feature vector and each of reference vectors, wherein all the amounts corresponding to the second feature vectors form one of the first feature vectors.

EE 35. The method according to EE 34, wherein the reference vectors are determined through one of the following methods:

random generating method where the reference vectors are randomly generated;

unsupervised clustering method where training vectors extracted from training samples are grouped into clusters and the reference vectors are calculated to represent the clusters respectively;

supervised modeling method where in the reference vectors are manually defined and learned from the training vectors; and eigen-decomposition method where the reference vectors are calculated as eigenvectors of a matrix with the training vectors as its rows.

EE 36. The method according to EE 34, wherein the relation between the second feature vectors and each of the reference vectors is measured by one of the following amounts:

distance between the second feature vector and the reference vector;

correlation between the second feature vector and the reference vector;

inter product between the second feature vector and the reference vector; and posterior probability of the reference vector with the second feature vector as the relevant evidence.

EE 37. The method according to EE 36, wherein the distance $v_j$ between the second feature vector x and the reference vector $z_j$ is calculated as $$v_j = \frac{\|x - z_j\|^2}{\sum_{j=1}^{M} \|x - z_j\|^2},$$

where M is the number of the reference vectors, $\|\ \|$ represents Euclidean distance.

EE 38. The method according to EE 36, wherein the posterior probability $p(z_j|x)$ of the reference vector $z_j$ with the second feature vector x as the relevant evidence is calculated as $$p(z_j \mid x) = \frac{p(x \mid z_j)p(z_j)}{\sum_{j=1}^{M} p(x \mid z_j)p(z_j)},$$

where $p(x|z_j)$ represents the probability of the second feature vector x given the reference vector $z_j$, M is the number of the reference vectors, $p(z_j)$ is the prior distribution.

EE 39. The method according to EE 33, wherein the parameters of the statistical models are estimated by a maximum likelihood method.

EE 40. The method according to EE 33, wherein the statistical models are based on one or more Dirichlet distributions.

EE 41. The method according to EE 33, wherein the content similarity is measured by one of the following metric:

Hellinger distance;

Square distance;

Kullback-Leibler divergence; and

Bayesian Information Criteria difference.

EE 42. The method according to EE 41, wherein the Hellinger distance $D(\alpha,\beta)$ is calculated as $$D(\alpha, \beta) = 2 - 2 \times \left[\frac{\Gamma\left(\sum_{k=1}^{d} \alpha_k\right)}{\prod_{k=1}^{d} \Gamma(\alpha_k)} \times \frac{\Gamma\left(\sum_{k=1}^{d} \beta_k\right)}{\prod_{k=1}^{d} \Gamma(\beta_k)}\right]^{\frac{1}{2}} \times \frac{\prod_{k=1}^{d} \Gamma\left(\frac{\alpha_k + \beta_k}{2}\right)}{\Gamma\left(\sum_{k=1}^{d} \frac{\alpha_k + \beta_k}{2}\right)},$$

where $\alpha_1, \ldots, \alpha_d > 0$ are parameters of one of the statistical models and $\beta_1, \ldots, \beta_d > 0$ are parameters of another of the statistical models, $d \geq 2$ is the number of dimensions of the first feature vectors, and $\Gamma(\ )$ is a gamma function.

EE 43. The method according to EE 41, wherein the Square distance $D_s$ is calculated as $$D_s = T_1^2 \frac{\prod_{k=1}^{d} \Gamma(2\alpha_k - 1)}{\Gamma\left(\sum_{k=1}^{d} (2\alpha_k - 1)\right)} - 2T_1T_2 \frac{\prod_{k=1}^{d} (\alpha_k + \beta_k - 1)}{\Gamma\left(\sum_{k=1}^{d} (\alpha_k + \beta_k - 1)\right)} + T_2^2 \frac{\prod_{k=1}^{d} (2\beta_k - 1)}{\Gamma\left(\sum_{k=1}^{d} (2\beta_k - 1)\right)},$$

where $$T_1 = \frac{\Gamma\left(\sum_{k=1}^{d} \alpha_k\right)}{\prod_{k=1}^{d} \Gamma(\alpha_k)}, \quad T_2 = \frac{\Gamma\left(\sum_{k=1}^{d} \beta_k\right)}{\prod_{k=1}^{d} \Gamma(\beta_k)},$$

$\alpha_1, \ldots, \alpha_d > 0$ are parameters of one of the statistical models and $\beta_1, \ldots, \beta_d > 0$ are parameters of another of the statistical models, $d \geq 2$ is the number of dimensions of the first feature vectors, and $\Gamma(\ )$ is a gamma function.

EE 44. An apparatus for measuring content similarity between two audio segments, comprising:

a feature generator which extracts first feature vectors from the audio segments, wherein all the feature values in each of the first feature vectors are non-negative and normalized so that the sum of the feature values is one;

a model generator which generates statistical models for calculating the content similarity based on Dirichlet distribution from the feature vectors; and a similarity calculator which calculates the content similarity based on the generated statistical models.

EE 45. The apparatus according to EE 44, wherein the feature generator is further configured to extract second feature vectors from the audio segments; and for each of the second feature vectors, calculate an amount for measuring a relation between the second feature vector and each of reference vectors, wherein all the amounts corresponding to the second feature vectors form one of the first feature vectors.

EE 46. The apparatus according to EE 45, wherein the reference vectors are determined through one of the following methods:

random generating method where the reference vectors are randomly generated;

unsupervised clustering method where training vectors extracted from training samples are grouped into clusters and the reference vectors are calculated to represent the clusters respectively;

supervised modeling method where in the reference vectors are manually defined and learned from the training vectors; and eigen-decomposition method where the reference vectors are calculated as eigenvectors of a matrix with the training vectors as its rows.

EE 47. The apparatus according to EE 45, wherein the relation between the second feature vectors and each of the reference vectors is measured by one of the following amounts:

distance between the second feature vector and the reference vector;

correlation between the second feature vector and the reference vector;

inter product between the second feature vector and the reference vector; and posterior probability of the reference vector with the second feature vector as the relevant evidence.

EE 48. The apparatus according to EE 47, wherein the distance $v_j$ between the second feature vector x and the reference vector $z_j$ is calculated as $$v_j = \frac{\|x - z_j\|^2}{\sum_{j=1}^{M} \|x - z_j\|^2},$$

where M is the number of the reference vectors, $\|\ \|$ represents Euclidean distance.

EE 49. The apparatus according to EE 47, wherein the posterior probability $p(z_j|x)$ of the reference vector $z_j$ with the second feature vector x as the relevant evidence is calculated as $$p(z_j \mid x) = \frac{p(x \mid z_j)p(z_j)}{\sum_{j=1}^{M} p(x \mid z_j)p(z_j)},$$

where $p(x|z_j)$ represents the probability of the second feature vector x given the reference vector $z_j$, M is the number of the reference vectors, $p(z_j)$ is the prior distribution.

EE 50. The apparatus according to EE 44, wherein the parameters of the statistical models are estimated by a maximum likelihood method.

EE 51. The apparatus according to EE 44, wherein the statistical models are based on one or more Dirichlet distributions.

EE 52. The apparatus according to EE 44, wherein the content similarity is measured by one of the following metric:

Hellinger distance;

Square distance;

Kullback-Leibler divergence; and

Bayesian Information Criteria difference.

EE 53. The apparatus according to EE 52, wherein the Hellinger distance $D(\alpha,\beta)$ is calculated as $$D(\alpha, \beta) = 2 - 2 \times \left[ \frac{\Gamma\left(\sum_{k=1}^{d} \alpha_k\right)}{\prod_{k=1}^{d} \Gamma(\alpha_k)} \times \frac{\Gamma\left(\sum_{k=1}^{d} \beta_k\right)}{\prod_{k=1}^{d} \Gamma(\beta_k)} \right]^{\frac{1}{2}} \times \frac{\prod_{k=1}^{d} \Gamma\left(\frac{\alpha_k + \beta_k}{2}\right)}{\Gamma\left(\sum_{k=1}^{d} \frac{\alpha_k + \beta_k}{2}\right)},$$

where $\alpha_1, \ldots, \alpha_d > 0$ are parameters of one of the statistical models and $\beta_1, \ldots, \beta_d > 0$ are parameters of another of the statistical models, $d \geq 2$ is the number of dimensions of the first feature vectors, and $\Gamma(\ )$ is a gamma function.

EE 54. The apparatus according to EE 52, wherein the Square distance $D_s$ is calculated as $$D_s = T_1^2 \frac{\prod_{k=1}^{d} \Gamma(2\alpha_k - 1)}{\Gamma\left(\sum_{k=1}^{d} (2\alpha_k - 1)\right)} - 2T_1T_2 \frac{\prod_{k=1}^{d} (\alpha_k + \beta_k - 1)}{\Gamma\left(\sum_{k=1}^{d} (\alpha_k + \beta_k - 1)\right)} + T_2^2 \frac{\prod_{k=1}^{d} (2\beta_k - 1)}{\Gamma\left(\sum_{k=1}^{d} (2\beta_k - 1)\right)},$$

where $$T_1 = \frac{\Gamma\left(\sum_{k=1}^{d} \alpha_k\right)}{\prod_{k=1}^{d} \Gamma(\alpha_k)}, \quad T_2 = \frac{\Gamma\left(\sum_{k=1}^{d} \beta_k\right)}{\prod_{k=1}^{d} \Gamma(\beta_k)},$$

$\alpha_l, \ldots, \alpha_d > 0$ are parameters of one of the statistical models and $\beta_l, \ldots, \beta_d > 0$ are parameters of another of the statistical models, $d \geq 2$ is the number of dimensions of the first feature vectors, and $\Gamma(\ )$ is a gamma function.

EE 55. A computer-readable medium having computer program instructions recorded thereon, when being executed by a processor, the instructions enabling the processor to execute a method of measuring content coherence between a first audio section and a second audio section, comprising:

for each of audio segments in the first audio section, determining a predetermined number of audio segments in the second audio section, wherein content similarity between the audio segment in the first audio section and the determined audio segments is higher than that between the audio segment in the first audio section and all the other audio segments in the second audio section; and calculating an average of the content similarity between the audio segment in the first audio section and the determined audio segments; and calculating first content coherence as an average of the averages calculated for the audio segments in the first audio section.

EE 56. A computer-readable medium having computer program instructions recorded thereon, when being executed by a processor, the instructions enabling the processor to execute a method of measuring content similarity between two audio segments, comprising:

extracting first feature vectors from the audio segments, wherein all the feature values in each of the first feature vectors are non-negative and normalized so that the sum of the feature values is one;

generating statistical models for calculating the content similarity based on Dirichlet distribution from the feature vectors; and calculating the content similarity based on the generated statistical models.

We claim:

1. A method of measuring content coherence between a first audio section and a second audio section, comprising:

for each of audio segments in the first audio section, determining a predetermined number of audio segments in the second audio section, wherein content similarity between the audio segment in the first audio section and the determined audio segments is higher than that between the audio segment in the first audio section and all the other audio segments in the second audio section; and calculating an average of the content similarity between the audio segment in the first audio section and the determined audio segments; and calculating first content coherence as an average, the minimum or the maximum of the averages calculated for the audio segments in the first audio section.

2. The method according to claim 1, further comprising:

for each of the audio segments in the second audio section, determining a predetermined number of audio segments in the first audio section, wherein content similarity between the audio segment in the second audio section and the determined audio segments is higher than that between the audio segment in the second audio section and all the other audio segments in the first audio section; and calculating an average of the content similarity between the audio segment in the second audio section and the determined audio segments;

calculating second content coherence as an average, the minimum or the maximum of the averages calculated for the audio segments in the second audio section;

calculating symmetric content coherence based on the first content coherence and the second content coherence.

3. The method according to claim 1, wherein each of the content similarity $S(s_{i,l}, s_{j,r})$ between the audio segment $s_{i,l}$ in the first audio section and the determined audio segments $s_{j,r}$ is calculated as content similarity between sequence $[s_{i,l}, \ldots, s_{i+L-1,l}]$ in the first audio section and sequence $[s_{j,r}, \ldots, s_{j+L-1,r}]$ in the second audio section, $L>1$.

4. The method according to claim 3, wherein the content similarity between the sequences is calculated by applying a dynamic time warping scheme or a dynamic programming scheme.

5. The method according to claim 1, wherein the content similarity between two audio segments is calculated by extracting first feature vectors from the audio segments;

generating statistical models for calculating the content similarity from the feature vectors; and calculating the content similarity based on the generated statistical models, wherein all the feature values in each of the first feature vectors are non-negative and the sum of the feature values is one, and the statistical models are based on Dirichlet distribution.

6. The method according to claim 5, wherein the extracting comprises:

extracting second feature vectors from the audio segments; and for each of the second feature vectors, calculating an amount for measuring a relation between the second feature vector and each of reference vectors, wherein all the amounts corresponding to the second feature vectors form one of the first feature vectors.

7. The method according to claim 6, wherein the reference vectors are determined through one of the following methods:

random generating method where the reference vectors are randomly generated;

unsupervised clustering method where training vectors extracted from training samples are grouped into clusters and the reference vectors are calculated to represent the clusters respectively;

supervised modeling method where the reference vectors are manually defined and learned from the training vectors; and eigen-decomposition method where the reference vectors are calculated as eigenvectors of a matrix with the training vectors as its rows.

8. An apparatus for measuring content coherence between a first audio section and a second audio section, comprising:

a similarity calculator which, for each of audio segments in the first audio section, determines a predetermined number of audio segments in the second audio section, wherein content similarity between the audio segment in the first audio section and the determined audio segments is higher than that between the audio segment in the first audio section and all the other audio segments in the second audio section; and calculates an average of the content similarity between the audio segment in the first audio section and the determined audio segments; and a coherence calculator which calculates first content coherence as an average, the minimum or the maximum of the averages calculated for the audio segments in the first audio section.

9. The apparatus according to claim 8, wherein the similarity calculator is further configured to, for each of the audio segments in the second audio section, determine a predetermined number of audio segments in the first audio section, wherein content similarity between the audio segment in the second audio section and the determined audio segments is higher than that between the audio segment in the second audio section and all the other audio segments in the first audio section; and calculate an average of the content similarity between the audio segment in the second audio section and the determined audio segments, and wherein the coherence calculator is further configured to calculate second content coherence as an average, the minimum or the maximum of the averages calculated for the audio segments in the second audio section, and calculate symmetric content coherence based on the first content coherence and the second content coherence.

10. The apparatus according to claim 8, wherein each of the content similarity $S(s_{i,l}, s_{j,r})$ between the audio segment si,l in the first audio section and the determined audio segments $s_{j,r}$ is calculated as content similarity between sequence $[s_{i,l}, \ldots, s_{i+L-1,l}]$ in the first audio section and sequence $[s_{j,r}, \ldots, s_{j+L-1,r}]$ in the second audio section, L>1.

11. The apparatus according to claim 10, wherein the content similarity between the sequences is calculated by applying a dynamic time warping scheme or a dynamic programming scheme.

12. The apparatus according to claim 8, wherein the similarity calculator comprises:

a feature generator which, for each of the content similarity, extracts first feature vectors from the associated audio segments;

a model generator which generates statistical models for calculating each of the content similarity from the feature vectors; and a similarity calculating unit which calculates the content similarity based on the generated statistical models, wherein all the feature values in each of the first feature vectors are non-negative and the sum of the feature values is one, and the statistical models are based on Dirichlet distribution.

13. A method of measuring content similarity between two audio segments, comprising:

extracting first feature vectors from the audio segments, wherein all the feature values in each of the first feature vectors are non-negative and normalized so that the sum of the feature values is one;

generating statistical models for calculating the content similarity based on Dirichlet distribution from the feature vectors; and calculating the content similarity based on the generated statistical models.

14. The method according to claim 13, wherein the extracting comprises:

extracting second feature vectors from the audio segments; and for each of the second feature vectors, calculating an amount for measuring a relation between the second feature vector and each of reference vectors, wherein all the amounts corresponding to the second feature vectors form one of the first feature vectors.

15. The method according to claim 14, wherein the reference vectors are determined through one of the following methods:

random generating method where the reference vectors are randomly generated;

unsupervised clustering method where training vectors extracted from training samples are grouped into clusters and the reference vectors are calculated to represent the clusters respectively;

supervised modeling method where in the reference vectors are manually defined and learned from the training vectors; and eigen-decomposition method where the reference vectors are calculated as eigenvectors of a matrix with the training vectors as its rows.

16. The method according to claim 14, wherein the relation between the second feature vectors and each of the reference vectors is measured by one of the following amounts:

distance between the second feature vector and the reference vector;

correlation between the second feature vector and the reference vector;

inter product between the second feature vector and the reference vector; and posterior probability of the reference vector with the second feature vector as the relevant evidence.

17. An apparatus for measuring content similarity between two audio segments, comprising:

a feature generator which extracts first feature vectors from the audio segments, wherein all the feature values in each of the first feature vectors are non-negative and normalized so that the sum of the feature values is one;

a model generator which generates statistical models for calculating the content similarity based on Dirichlet distribution from the feature vectors; and a similarity calculator which calculates the content similarity based on the generated statistical models.

18. The apparatus according to claim 17, wherein the feature generator is further configured to extract second feature vectors from the audio segments; and for each of the second feature vectors, calculate an amount for measuring a relation between the second feature vector and each of reference vectors, wherein all the amounts corresponding to the second feature vectors form one of the first feature vectors.

19. The apparatus according to claim 18, wherein the reference vectors are determined through one of the following methods:

random generating method where the reference vectors are randomly generated;

unsupervised clustering method where training vectors extracted from training samples are grouped into clusters and the reference vectors are calculated to represent the clusters respectively;

supervised modeling method where in the reference vectors are manually defined and learned from the training vectors; and eigen-decomposition method where the reference vectors are calculated as eigenvectors of a matrix with the training vectors as its rows.

20. The apparatus according to claim 18, wherein the relation between the second feature vectors and each of the reference vectors is measured by one of the following amounts:

distance between the second feature vector and the reference vector;

correlation between the second feature vector and the reference vector;

inter product between the second feature vector and the reference vector; and posterior probability of the reference vector with the second feature vector as the relevant evidence.

* * * * *